US011043097B1

(12) United States Patent
Edwards et al.

(10) Patent No.: US 11,043,097 B1
(45) Date of Patent: Jun. 22, 2021

(54) ACTIVITY AND AGGRESSION DETECTION AND MONITORING IN A CONTROLLED-ENVIRONMENT FACILITY

(71) Applicant: Securus Technologies, Inc., Dallas, TX (US)

(72) Inventors: Adam C. Edwards, Fort Worth, TX (US); Luke Keiser, Frisco, TX (US)

(73) Assignee: Securus Technologies, LLC, Carrollton, TX (US)

( * ) Notice: Subject to any disclaimer, the term of this patent is extended or adjusted under 35 U.S.C. 154(b) by 770 days.

(21) Appl. No.: 14/504,280

(22) Filed: Oct. 1, 2014

(51) Int. Cl.
*G08B 21/02* (2006.01)
*G08B 13/196* (2006.01)

(52) U.S. Cl.
CPC ..... *G08B 21/02* (2013.01); *G08B 13/19697* (2013.01)

(58) Field of Classification Search
CPC ..... G01F 23/36; B05B 12/004; B05C 5/0225; B05C 11/10; G08C 15/12; G08B 13/22; G08B 27/003; G08B 21/10; G08B 27/00; G08B 21/02; G08B 13/19697
USPC .. 340/500, 506, 539.26, 540, 573.1, 870.09; 348/143, 159, 154, 155, 142, 152
See application file for complete search history.

(56) References Cited

U.S. PATENT DOCUMENTS

2008/0146892 A1* 6/2008 LeBoeuf ..... G06Q 30/0251 600/300
2013/0124240 A1* 5/2013 Varadarajan ..... G06Q 50/20 705/7.11
2013/0307980 A1* 11/2013 Stone ..... H04N 7/181 348/148
2014/0318699 A1* 10/2014 Longinotti-Buitoni ..... A41D 1/002 156/247
2015/0035976 A1* 2/2015 Mayuzumi ..... H04N 7/183 348/143
2016/0061794 A1* 3/2016 Schultz ..... G01N 21/63 702/24

* cited by examiner

*Primary Examiner* — Hai Phan
*Assistant Examiner* — Anthony D Afrifa-Kyei
(74) *Attorney, Agent, or Firm* — Fogarty LLP

(57) ABSTRACT

Activity and aggression detection and monitoring in a controlled-environment facility includes gathering audio, video and/or telemetry input from one or more dedicated and/or ad hoc sensors disposed in portions of the controlled-environment facility. A baseline normal input level from each of the sensors indicative of normal activity in the controlled-environment facility (proximate to a subject sensor) is predetermined. A determination is then made whether the input from each of the sensors rises above or falls below the predetermined normal input level, and when it does, the sensor input of the subject sensor may be recorded. When input from a sensor rises above or falls below the predetermined normal input level, an alert may be issued to controlled-environment facility personnel and/or law enforcement, the input from the subject sensor may be streamed to the personnel, and/or a recording of the sensor input may be offered.

23 Claims, 4 Drawing Sheets

ACTIVITY AND AGGRESSION DETECTION AND MONITORING IN A CONTROLLED-ENVIRONMENT FACILITY

TECHNICAL FIELD

The present disclosure is related to operation of controlled-environment facilities, and particularly to activity and aggression detection and monitoring within such controlled-environment facilities.

BACKGROUND

Fights, physical or verbal, are commonplace in controlled-environment facilities and may escalate to more serious problems, even full-blown riots. Traditionally, such situations have been dealt with through segregation of specific segments of the population of a controlled-environment facility or through similar action. For example, in a correctional institution environment, members of rival gangs may be housed in separate cellblocks, pods, or the like. According to the International Centre for Prison Studies, the United States has the highest prison population per capita in the world. In 2009, for example, 1 out of every 135 U.S. residents was incarcerated. Typically, inmates convicted of felony offenses serve long sentences in prison (e.g., federal or state prisons), whereas those convicted of misdemeanors receive shorter sentences to be served in jail (e.g., county jail). As a result, overcrowding in controlled-environment facilities such as prisons or jails lead to an even greater number of confrontations. Typical responses to such situations are "after-the-fact." That is, oftentimes, facility and/or law enforcement personnel only become aware of the altercation after one or more parties have been injured or even killed.

SUMMARY

The present systems and methods for activity and aggression detection and monitoring in a controlled-environment facility are directed to embodiments that include a controlled-environment facility management system, or the like, that may gather audio, video and/or telemetry input from one or more dedicated and/or one or more ad hoc sensors disposed in portions of a controlled-environment facility. Such sensors may be dedicated sensors, such as those associated with security systems, security cameras, or the like, or such sensors may be "ad hoc" sensors. For example, in accordance with various embodiments ad hoc audio sensors may include a microphone or mouthpiece of a controlled-environment facility resident community telephone or videophone, a microphone of a controlled-environment facility resident digital media device, and/or the like. Similarly, ad hoc video sensors may include a video sensor and the input may be one or more video images. Correspondingly, the ad hoc video sensor may be a camera of a resident community videophone, a video camera of a controlled-environment facility resident digital media device, or the like. Other ad hoc sensors may include resident "wearables," such as Radio Frequency Identification (RFID) tagged or biometric monitoring bracelets, necklaces, watches or glasses, biometrically monitored clothing, or the like.

The controlled-environment facility management system, or the like may predetermine a normal input level or baseline input from each of the sensors. This normal input level may be indicative of normal activity in the controlled-environment facility, proximate to a subject sensor. A normal input level of sound input may be based, at least in part, on a volume of the sound, a sharpness of a sound, recognition of one or more particular keywords being spoken, or the like. Correspondingly, a normal video input level may be based at least in part on a speed of movement in video images, an amount of movement in the video images, recognition of one or more particular persons and their location with respect to one or more other recognized particular persons, an amount of a particular color in the video images, and/or the like. Normal input levels for telemetry from resident wearable devices might include location, speed of movement, resident biometrics, etc.

The controlled-environment facility management system, or the like, may thereafter determine when input from each of the sensors rises above or falls below the predetermined normal input level for the subject sensor and alert controlled-environment facility personnel and/or law enforcement. This alert may comprise one or more text messages, or the like, which may afford the controlled-environment facility personnel and/or law enforcement an opportunity to review a recording of the input of the subject sensor and/or stream a feed of input from the subject sensor. Therefor, in accordance with embodiments of the present systems and methods the input from the subject sensor may be recorded when input from the subject sensor rises above or falls below the predetermined normal input level for the subject sensor.

In various embodiments, one or more of the techniques described herein may be performed by one or more computer systems. In other various embodiments, a tangible computer-readable storage medium may have program instructions stored thereon that, upon execution by one or more computer systems, cause the one or more computer systems to execute one or more operations disclosed herein. In yet other various embodiments, one or more systems may each include at least one processor and memory coupled to the processors, wherein the memory is configured to store program instructions executable by the processor(s) to cause the system(s) to execute one or more operations disclosed herein.

The foregoing has outlined rather broadly the features and technical advantages of the present invention in order that the detailed description of the invention that follows may be better understood. Additional features and advantages of the invention will be described hereinafter, which form the subject of the claims of the invention. It should be appreciated that the conception and specific embodiment disclosed may be readily utilized as a basis for modifying or designing other structures for carrying out the same purposes of the present invention. It should also be realized that such equivalent constructions do not depart from the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

Figure 1:
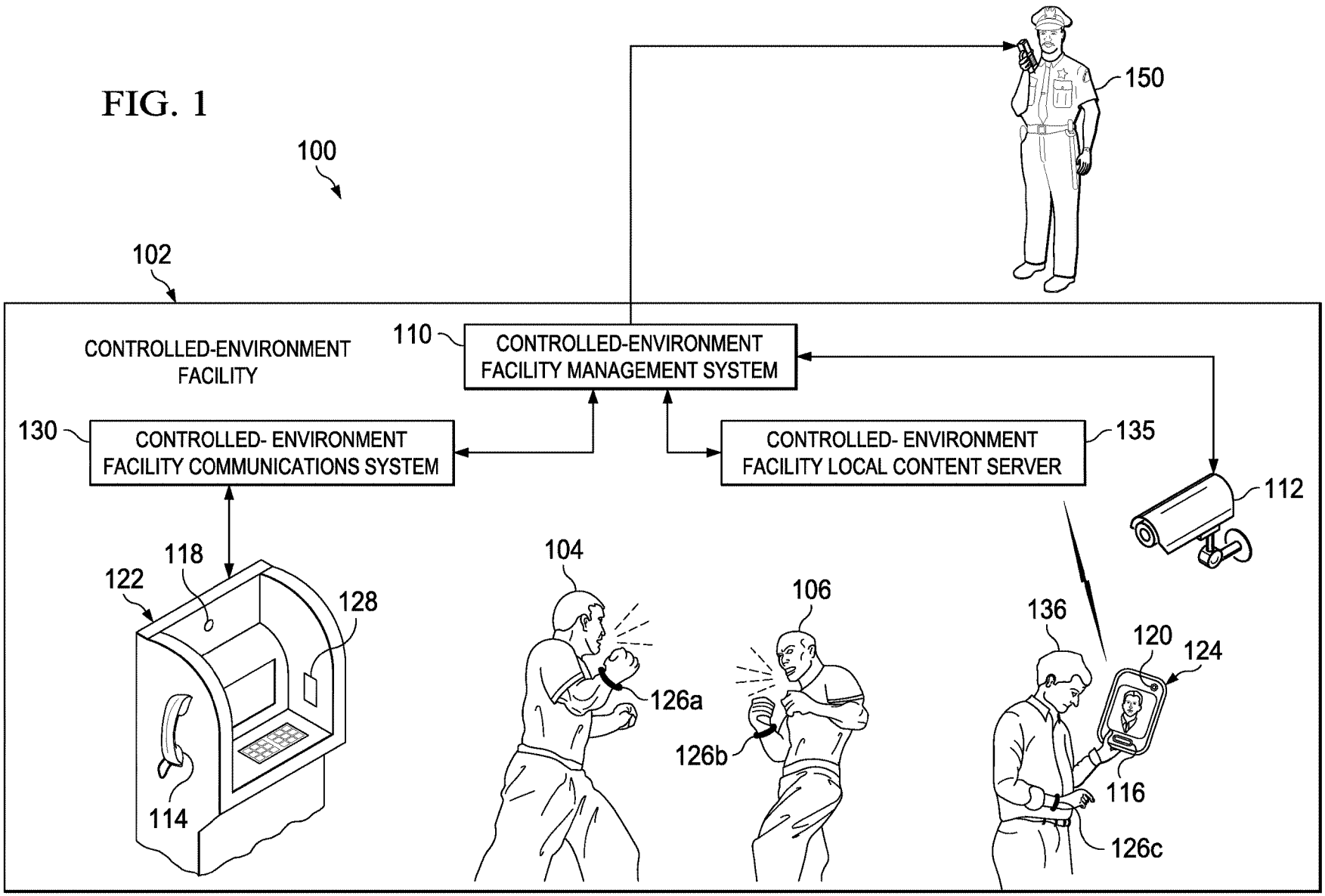
Figure 2:
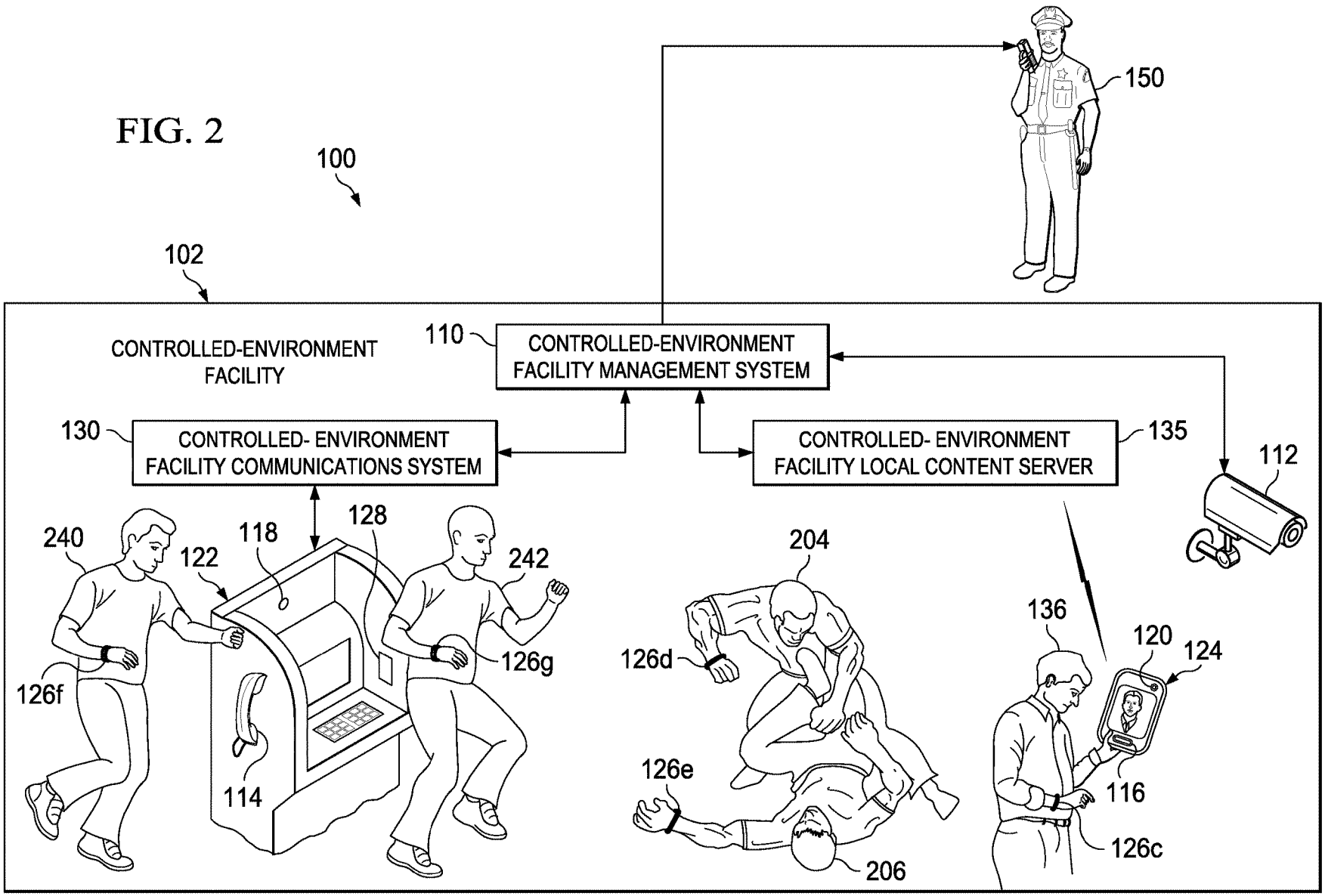
Figure 3:
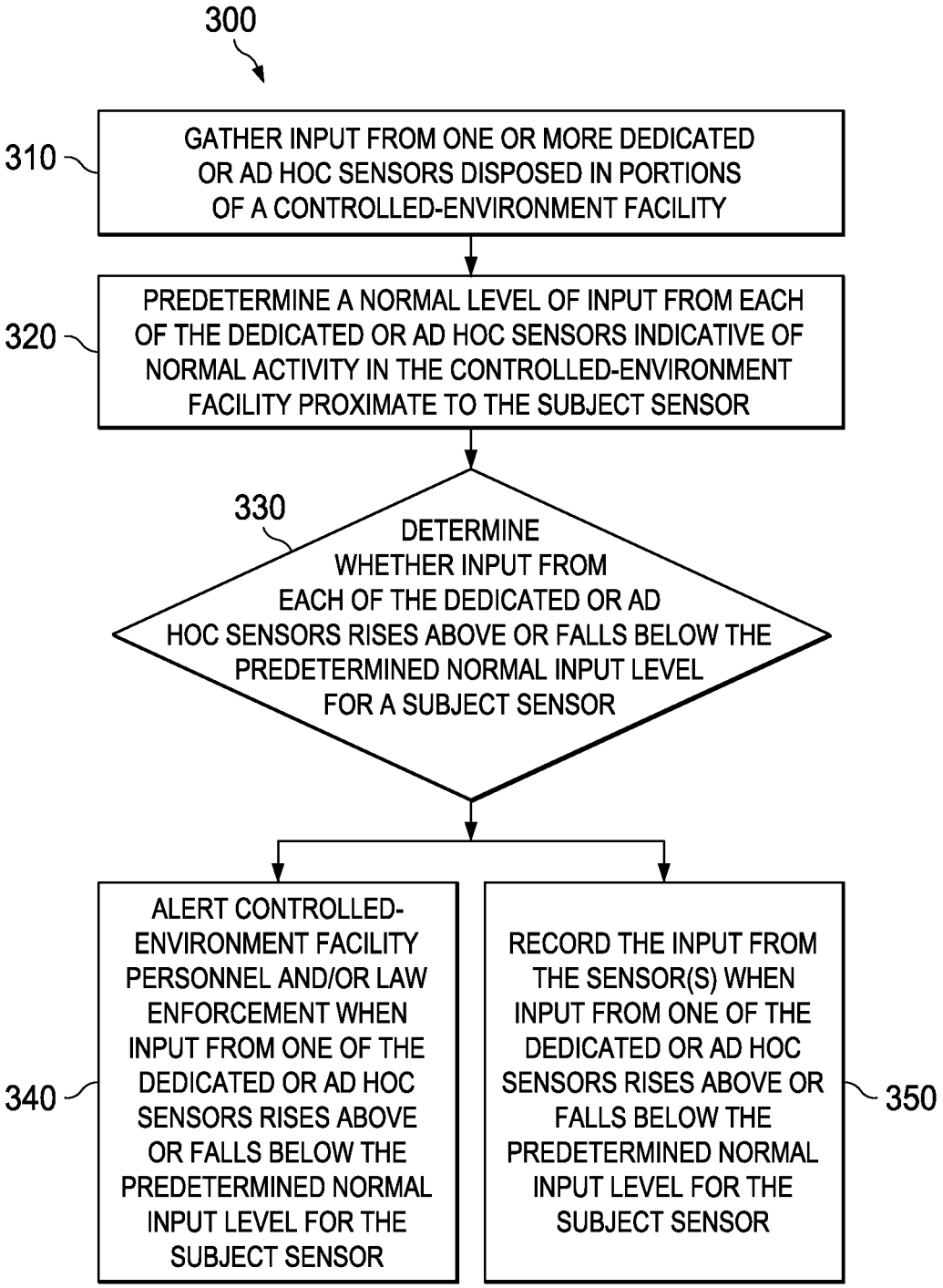
Figure 4:
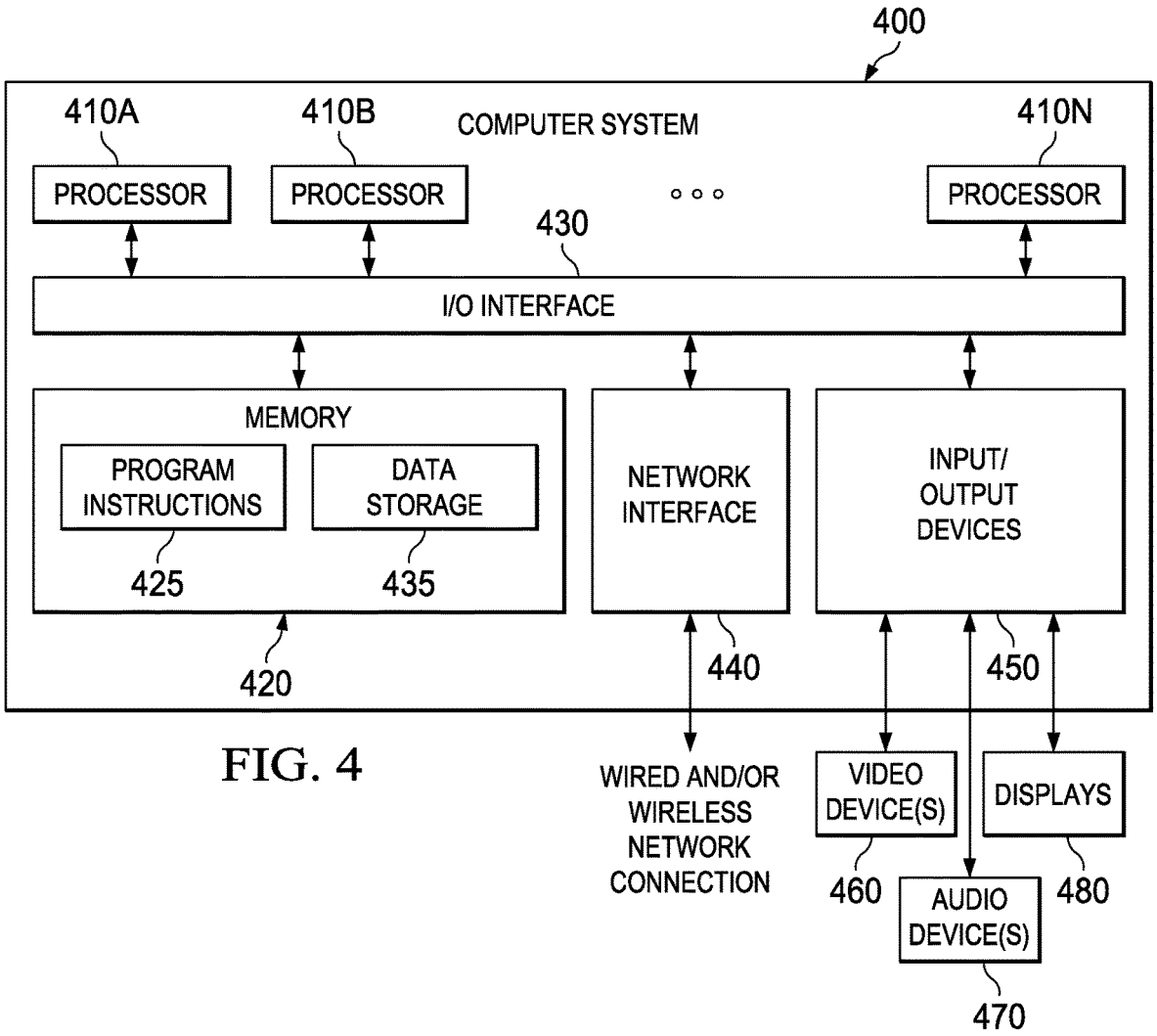

Having thus described the invention in general terms, reference will now be made to the accompanying drawings, which are not necessarily drawn to scale, and wherein:

FIG. 1 is a diagrammatic illustration of an example controlled-environment facility employing an embodiment of the present systems and methods to detect two residents verbally arguing, according to some embodiments;

FIG. 2 is a diagrammatic illustration of an example controlled-environment facility employing the embodiment of FIG. 1 to directly or indirectly detect two residents physically fighting, according to some embodiments;

FIG. 3 is a flowchart of an example implementation of a procedure for activity and aggression detection and monitoring in a controlled-environment facility, according to some embodiments; and FIG. 4 is a block diagram of a computer system, device, or station configured to implement various techniques disclosed herein, according to some embodiments.

DETAILED DESCRIPTION

The invention now will be described more fully hereinafter with reference to the accompanying drawings. This invention may, however, be embodied in many different forms and should not be construed as limited to the embodiments set forth herein. Rather, these embodiments are provided so that this disclosure will be thorough and complete, and will fully convey the scope of the invention to those skilled in the art. One skilled in the art may be able to use the various embodiments of the invention.

For example, various types of controlled-environment facilities are present in today's society, and persons may be voluntary or involuntary residents of such facilities, whether temporarily or permanently. Examples of controlled-environment facilities may include correctional institutions (e.g., municipal jails, county jails, state prisons, federal prisons, military stockades, juvenile facilities, detention camps, home incarceration environments, etc.), healthcare facilities (e.g., hospitals, nursing homes, mental health facilities, rehabilitation facilities, such as drug and alcohol rehabilitation facilities, etc.), restricted living quarters (e.g., hotels, resorts, camps, dormitories, barracks, etc.), and the like. Such correctional facilities present numerous difficulties in areas such as security, surveillance, financial transactions, communications, visitation, investigation, budgetary, etc.; which in turn make technological implementations uniquely challenging in those environments. For convenience of explanation, various examples discussed herein are presented in the context of correctional facilities, or the like. For instance, in some of the embodiments discussed below, a controlled-environment facility may be referred to as a correctional facility, jail or prison, and its residents may be referred to as inmates, arrestees, or detainees. In many cases, technologies that are used outside of correctional facilities are not immediately applicable to the correctional environment without significant changes and modifications. Moreover, correctional facilities may have specific needs that are not particularly relevant outside of those environments. However, it should be understood, that the systems and methods described herein may be similarly applicable to other types of controlled-environment facilities and their respective residents (e.g., a camp and its campers, a school (dormitory) and its students, etc.).

Embodiments of the present systems and methods for activity and aggression detection and monitoring in a controlled-environment facility are generally related to operation of controlled-environment facilities, and particularly directed to activity and aggression detection and monitoring within such controlled-environment facilities. In accordance with embodiments of the present systems and methods, activity and aggression detection and monitoring in a controlled-environment facility includes gathering audio and/or video input from one or more dedicated and/or ad hoc audio, video and/or telemetry sensors disposed in portions of the controlled-environment facility. A baseline input from each of the sensors indicative of normal activity in the controlled-environment facility (proximate to a subject sensor) may be predetermined. A determination is then made whether the input from each of the sensors rises above or falls below this predetermined normal input level, and when it does, the sensor input of the subject sensor may be recorded. When input from one or more of the sensors rises above or falls below the predetermined normal input level for the subject sensor, an alert is issued to controlled-environment facility personnel and/or to "law enforcement," such as to particular law enforcement personnel or law enforcement in general (e.g., by providing an alert to a 911 emergency system). The audio and/or video input from the subject sensor may be streamed to the personnel, and/or a recording of the sensor input may be offered to the personnel.

FIG. 1 is a diagrammatic illustration of example controlled-environment facility system 100 for monitoring and detecting activity and aggression in controlled-environment facility 102, employing an embodiment of the present systems and methods to detect two residents 104 and 106 verbally arguing, according to some embodiments. Similarly, FIG. 2 is a diagrammatic illustration of example controlled-environment facility system 100 for monitoring and detecting activity and aggression in controlled-environment facility 102, employing the embodiment of FIG. 1 to directly or indirectly detect two residents 204 and 206 physically fighting, according to some embodiments.

In accordance with embodiments of the present systems and methods, controlled-environment facility 102 may include controlled-environment facility management system 110, such as a Jail Management System (JMS), or the like in correctional institution embodiments. Controlled-environment facility management system 110 may, in accordance with embodiments of the present systems and methods, gather input from one or more dedicated and/or ad hoc sensors (112, 114, 116, 118, 120, 128, etc.) disposed in portions of controlled-environment facility 102. These audio, video and/or telemetry sensors are disposed about controlled-environment facility 102. In accordance with some embodiments, these video and/or audio sensors may be dedicated sensors, purposefully disposed for gathering information, such as surveillance camera 112, wall mounted audio-visual sensors, or the like. However, less conspicuous, ad hoc sensors may be provided by a microphone 114 or 116 and/or camera 118 or 120 associated with community resident telephone/videophone terminal 122 and/or resident media device 124, respectively. Also such ad hoc sensors may be provided through resident wearables, such as Radio Frequency Identification (RFID) tagged and/or biometric monitoring bracelets (126*a-g*), necklaces, watches or eyeglasses, clothing, or the like, such as in conjunction with RFID readers 128, biometric monitoring functionality, or the like. Such wearables may provide audio sensor input, location input, wearer heart rate, wearer body temperature, and/or other wearer biometric data, such as the wearer's sleep state, general health, level of agitation, etc.

Telephone/videophone terminal 122, which may be referred to as an intelligent facility device is a replacement for typical phones provided in controlled-environment facilities, such as rehabilitation centers, jails and prisons, utilizing existing facility telephony wiring. While telephone/videophone terminal 122 is illustrated in FIGS. 1 and 2 as a kiosk-type terminal, this intelligent facility device may also take the form of a hardened, wall mounted device. The intelligent facility device replaces a typical pay phone found in some facilities and may provide touch screen computer functionality that enables a resident to perform "self service" tasks such as setting up doctor appointments, scheduling visitation, viewing schedules, and checking the status of his or her case. The intelligent facility device may include RFID reader 128 to enable precise identification of each resident. In addition, the intelligent facility device includes, as noted, a built-in camera and telephone handset to enable a resident to use video conferencing to meet face to face with attorneys, family and friends. As noted this built-in camera 118 and the receiver mouthpiece 114 may be used as sensors in accordance with embodiments of the present systems and methods.

Further, embodiments of the present systems and methods may make use of cameras and/or microphones of intelligent facility devices, which resemble wall-mounted tablet computing devices, which may be specially adapted for use in the controlled-environment facility similar to resident media devices described below.

Resident media device 124 may be a specially adapted, or otherwise facility approved, controlled-environment facility resident tablet computing device, media player, or the like. Controlled-environment facility resident media device 124 may be a tablet computing device adapted and/or approved for use by residents of the controlled-environment facility (within the controlled-environment facility). Each tablet computing device 124 may be particularly adapted for use in a controlled-environment. For example, in a correctional institution, jail, or the like, such a tablet computing device may have a specially adapted operating system and/or may be "stripped-down," particularly from the standpoint of what applications programs (apps) and/or hardware are provided or allowed on tablet computing device 124, and/or connectivity afforded such a tablet computing device. For example, such a resident tablet computing device may employ an operating system kernel based upon an open source platform such as the CyanogenMod ANDROID™—based operating system or the like, which may be rebuilt for use in such a tablet computing device in a controlled-environment facility. In such an example, the tablet computing device may be adapted to only connect to a network provided by the controlled-environment facility. Also, the resident tablet may have a few fixed apps pre-installed on the device, and installation of further apps on the device may be forbidden (i.e. prevented by modifications to the device's operating system, or the like) and/or restricted, such as by requiring permission from a facility administrator, or the like. Apps provided on resident tablets might include apps of particular interest to residents of the controlled-environment facility. For example, tablet computing devices provided to inmates of correctional facilities, might include apps that may be of particular use to an inmate, in general, such as access to a legal research service, or of more specific interest, such as providing an inmate nearing release, access to employment searching apps or the like. Hence, such inmate tablet computing devices may be used to help soon to be released inmates transition. For example, the tablet may be used to communicate with a future employer, or the like. As such, tablets may be sponsored, or otherwise subsidized by organizations or companies, assisting with the transition of inmates into society.

In accordance with various embodiments of the present systems and methods, not only does surveillance camera 112, but also community resident telephone/videophone terminal 122 and/or resident media device 124 operate under direction of controlled-environment facility management system 110, to one degree or another. For example, community resident telephone/videophone terminal 122 may operate at least in part under control of controlled environment facility communications system 130, which in turn may be controlled, at least in part, by controlled-environment facility management system 110. Similarly, resident media device 124 may operate at least in part under control of controlled environment local content server 135, and/or controlled environment facility communications system 130, or the like (such as via a controlled-environment facility wireless network). Controlled-environment facility local content server 135 may also be controlled, at least in part, by controlled-environment facility management system 110. Thus, since community resident telephone/videophone terminal 122 and/or resident media device 124 operate under direction of controlled-environment facility management system 110, these devices may be used by controlled-environment facility management system 110, whether the respective device (122, 124) is in use or not, to gather sensor input in accordance with embodiments of the present systems and methods. In accordance with some embodiments, use, or even possession of, a resident media device (124) by resident 136 may be conditional upon such use of the device as an ad hoc sensor by controlled-environment facility management system 110.

RFID bracelets may be used in controlled-environment facilities for identification for transactions, to grant access to specific areas, and/or the like. For example, a resident RFID bracelet may be used by a resident to access community telephone/videophone 122, pay for calls made on phone 122, etc., such as by scanning the bracelet under RFID reader 128.

A normal input level or baseline of input from each of these dedicated and/or ad hoc sensors (112, 114, 116, 118, 120, 128, etc.) may be established by controlled-environment facility management system 110 by gathering inputs at various times of day, or in various conditions. Preferably, such a normal input level is indicative of normal activity in the controlled-environment facility, proximate to the subject sensor, in particular circumstances. For example, the normal input level for each sensor may comprise an upper input threshold level and a lower input threshold level, thus establishing a range for the normal input level.

In accordance with embodiments of the present systems and methods, a normal input level threshold of sound input might be based at least in part on a volume or sharpness of sounds. Additionally, or alternatively, violation of a threshold of sound input may be based at least in part on recognition by controlled-environment facility management system 110 of particular keywords being spoken. For example, in FIG. 1, yelling by one or both of residents 104 and 106 may violate the volume and/or sharpness threshold, while what is said may violate a keyword threshold.

Violation of a video and/or wearables normal input level(s) may be based at least in part on a speed of movement in video images and/or wearables telemetry. For example, in FIG. 2 running movement of residents 240 and 242 may be determined from video images received from video camera 118, and/or RFID telemetry received from RFID reader 128 of community resident telephone/videophone terminal 122, as residents 240 and 242 move toward fighting residents 204 and 206. As running individuals pass multiple sensors a direction toward a location of an incident may be deduced by system 110. A movement threshold could be based on speed or suddenness of the movement (e.g. a punch being thrown), the amount of movement (e.g. a rush of a large number of people to a fight), or similar metrics. Hence, in FIG. 2, not only may system 100 detect the fight indirectly from the movement of residents 240 and 242 toward the fight, but the actions of fighting residents 204 and 206 (such as the throwing of punches, etc.) may also, or alternatively, violate speed and/or suddenness of movement threshold(s) for video and/or wearables. Conversely, a lower threshold of movement may be based on a lack of movement, where movement is expected, which could indicate unconsciousness or even death of an individual.

In accordance with some embodiments of the present systems and methods, violation of a video threshold may be based at least in part on recognition by controlled-environment facility management system 110 of one or more particular persons in a particular area, and/or adjacent to (or within a predefined distance from) one or more other particular persons. For example, in FIG. 1, even if residents 104 and 106 were not yelling at one another, if they were recognized as people who are hostile to one another, such as members of rival gangs, such as through video images provided by community resident telephone/videophone terminal 122 and/or resident media device 124, a video threshold may be violated. Conversely, if the individuals were recognized as people who are not suppose to associate with one another, such as a gang leader and a resident gang member that is soon to be released, a video threshold may be violated. Additionally or alternative, a normal video input level may be based, at least in part, on an amount of a particular color in video images, which might be indicative of a particular gang congregating, or a ratio of colors, which might show a particular gang congregating around a few individuals of a rival gang.

Controlled-environment facility management system 110 may determine whether the input from each of the sensors (112, 114, 116, 118, 120, 128, etc.) rises above or falls below such predetermined normal input level(s) for the subject sensor(s) and alert controlled-environment facility and/or law enforcement 150 when input from one of the sensors (112, 114, 116, 118, 120, 128, etc.) rises above or falls below the predetermined normal input level for the subject sensor. This alert may be a text message, or the like, and may include a feed of the sensor input and/or a recording of sensor input surrounding the sensor input rising above or falling below the normal input level. For example, the recording may be of several seconds video and/or sound from a few seconds before to a few seconds after the threshold exceeding event for the controlled-environment facility personnel and/or law enforcement to evaluate, before taking action. For example, in a correctional facility environment, the sound of an inmate dropping a metal lunch tray and the sound of one inmate striking another with a metal lunch tray may both exceed a input threshold, but facility personnel and/or law enforcement would be able to discern the difference in the sounds.

Hence, in accordance with embodiments of the present systems and methods, the input from one of the dedicated and/or ad hoc sensors (112, 114, 116, 118, 120, 128, etc.) may be recorded, or otherwise retained, when input from one of the dedicated and/or ad hoc sensors rises above or falls below the predetermined normal input level for the subject sensor. For example, the recording may be of several seconds of video and/or sound from a few seconds before to a few seconds after the threshold-exceeding event. To facilitate such recording, input from the dedicated and/or ad hoc sensors (112, 114, 116, 118, 120, 128, etc.) may be buffered, such as by controlled-environment facility management system 110, so that upon violation of a normal input level, the recoding discussed above may include the portion of the input a few seconds before the normal input level violation.

In accordance with proactive embodiments of the present systems and methods, facility personnel can be preemptively alerted to abnormal activity in a particular portion of the facility and/or with respect a particular resident. For example, in a corrections environment, a guard on his or her way to move a prisoner to another location could be alerted of not only unusual sound or movement by or near the prisoner, but may also be alerted of any unusual biometrics of the resident, such as, an elevated heart rate (for an extended period of time), lack of sleep (for an extended period of time), elevated body temperature etc., which may be provided In accordance with embodiments of the present systems and methods via wearables, such as biometric monitoring bracelets, necklaces, watches or glasses, biometrically monitored clothing, and/or the like.

FIG. 3 is a flowchart of an example implementation of procedure 300 for activity and aggression detection and monitoring in a controlled-environment facility, according to some embodiments. Therein, at 310, a controlled-environment facility management system (110), or similar computer system, gathers input from one or more dedicated and/or ad hoc sensors (112, 114, 116, 118, 120, 128, etc.) disposed in portions of a controlled-environment facility (102). As noted above, in addition to conventional monitoring devices, such as associated with security cameras (112), wall mounted audio-visual sensors, or the like, audio sensors may take the form of a microphone (114) of a controlled-environment facility resident community telephone (122), the microphone (116) of a controlled-environment facility resident digital media device (124), etc. Likewise, video sensors may include not only security cameras (112), and the like, but also a camera (118) of a resident community videophone (terminal) (122), the camera of a (120) controlled-environment facility resident digital media device (124), RFID readers (128), and/or the like. As also discussed above, the cameras and microphones of such devices may be used in accordance with some embodiments of the present systems and methods whether or not the device is in use.

At 320 a normal input level or baseline of input is predetermined (i.e. calculated or otherwise established) for each of the one or more dedicated and/or ad hoc sensors. This normal input level is intended to be indicative of normal activity in the controlled-environment facility in the proximity of the subject sensor. For example, as noted above, the normal input level for each sensor may comprise an upper input threshold and a lower input threshold, thus establishing a range for the normal input level. This normal input level may vary based on a time of day, scheduled activities in the controlled-environment facility, or the like. For example, normal input level sound levels on "Superbowl Sunday" in a correctional facility may be much higher than on a typical Sunday. Further, this normal input level may vary based on a location of mobile sensors, such as the camera and/or microphone of resident media device (124), discussed above. For example, the ambient sound level while the resident media device (124) is in a cafeteria area during lunch will be much louder and full of sharper noise events than wile the resident is in a sleeping area, or the like. Likewise while a resident media device is in an outdoor exercise yard or the like movement in captured video or from RFID telemetry may be more expansive, but less sensitive, than while the resident and device are in common areas within the controlled-environment facility.

At 330 a determination may be made, such as by the controlled-environment facility management system, as to whether the input from each of the dedicated and/or ad hoc sensors rises above or falls below the respective normal input level for a subject sensor, such as was predetermined at 320. For example, if the input from a sensor is sound, the normal input level may be established based upon, and the sound may be monitored for, volume of the sound, sharpness of sound events, particular keywords being spoken, and/or the like. Correspondingly, video and/or wearables thresholds may be based upon, and video may be monitored for, speed and/or amount of movement in video images or RFID telemetry, amount of a particular color in video images, recognition (such as by the controlled-environment facility management system) of one or more particular persons (in a particular area) adjacent to one or more other particular persons in video images, and/or the like. Biometric telemetry thresholds from biometric monitoring bracelets, necklaces, watches or eyeglasses, clothing, or the like, may be based upon audio sensor input, location input, wearer heart rate, wearer body temperature, and/or other wearer biometric data, such as the wearer's sleep state, general health, level of agitation, etc.

If input from one (or more) of the sensors rises above or falls below the predetermined normal input level for that sensor (those sensors) at 330, controlled-environment facility personnel and/or law enforcement may be alerted at 340, such as by the controlled-environment facility management system, and at 350 input from the subject (and surrounding) sensor(s) may be recorded. As noted, the alert may take the form of one or more text messages sent to one or more controlled-environment facility personnel and/or law enforcement. Additionally, or alternatively, as also discussed above, the alert may include a streaming, and/or recorded input from the subject sensor(s), for evaluation, and/or monitoring by the controlled-environment facility personnel and/or law enforcement.

Moreover, violation of thresholds that can be attributed to particular individuals may be use an input into investigative analysis and intelligence systems based on communications into and out of controlled-environment facilities to produce reports to indicate possible accomplices and co-conspirators to the suspected activity, which caused the threshold violation.

Embodiments of the present systems and methods for activity and aggression detection and monitoring in a controlled-environment facility, as described herein, may be implemented or executed, at least in part, by one or more computer systems. One such computer system is illustrated in FIG. 4. In various embodiments, computer system 400 may be a server, a mainframe computer system, a workstation, a network computer, a desktop computer, a laptop, a tablet computing device, media player, or the like. For example, in some cases, computer 400 may implement one or more steps of example process 300 described above with respect to FIG. 3, and/or a computer system such as computer system 400 may be used as, or as part of, one or more of controlled environment facility management system 110, controlled environment facility communications system 130, controlled-environment facility local content server 135, community resident telephone/videophone system 122, resident media device 124, and/or the like. In various embodiments two or more of these computer systems may be configured to communicate with each other in any suitable way, such as, for example, via a network (e.g., in FIGS. 1 and 2 resident media device 124 is illustrated as wirelessly communicating with controlled-environment facility local content server 135, and controlled environment facility management system 110, controlled environment facility communications system 130, controlled-environment facility local content server 135, community resident telephone/videophone system 122 and security camera 112 are illustrated as communicating with one another, such as via a local area network, direct wire-line connections, or the like.

As illustrated, example computer system 400 includes one or more processors 410 coupled to a system memory 420 via an input/output (I/O) interface 430. Example computer system 400 further includes a network interface 440 coupled to I/O interface 430, and one or more input/output devices 450, such as video device(s) 460 (e.g., a camera), audio device(s) 470 (e.g., a microphone and/or a speaker), and display(s) 480. In accordance with embodiments of the present systems and methods, video devices 460 may be cameras 112, 118 and or 120, and audio devices 470 may be microphones 114, 116, or the like. Further, RFID reader 128 may be such an input device. Computer system 400 may also include a cursor control device (e.g., a mouse or touchpad), a keyboard, etc. Multiple input/output devices 450 may be present in computer system 400 or may be distributed on various nodes of computer system 400. In some embodiments, similar input/output devices may be separate from computer system 400 and may interact with one or more nodes of computer system 400 through a wired or wireless connection, such as over network interface 440, such as sensors (112, 114, 116, 118, 120, 128, etc.), biometrically monitored wearables, or the like.

In various embodiments, computer system 400 may be a single-processor system including one processor 410, or a multi-processor system including two or more processors 410 (e.g., two, four, eight, or another suitable number). Processors 410 may be any processor capable of executing program instructions. For example, in various embodiments, processors 410 may be general-purpose or embedded processors implementing any of a variety of instruction set architectures (ISAs), such as the x86, POWERPC®, ARM®, SPARC®, or MIPS® ISAs, or any other suitable ISA. In multi-processor systems, each of processors 410 may commonly, but not necessarily, implement the same ISA. Also, in some embodiments, at least one processor 410 may be a graphics processing unit (GPU) or other dedicated graphics-rendering device.

System memory 420 may be configured to store program instructions and/or data accessible by processor 410. In various embodiments, system memory 420 may be implemented using any suitable memory technology, such as static random access memory (SRAM), synchronous dynamic RAM (SDRAM), nonvolatile/Flash-type memory, or any other type of memory. As illustrated, program instructions and data implementing certain operations, such as, for example, those described in connection with FIGS. 1 through 3, may be stored within system memory 420 as program instructions 425 and data storage 435, respectively. In other embodiments, program instructions and/or data may be received, sent or stored upon different types of computer-accessible media or on similar media separate from system memory 420 or computer system 400. Generally speaking, a computer-readable medium may include any tangible or non-transitory storage media or memory media such as magnetic or optical media—e.g., disk or CD/DVD-ROM coupled to computer system 400 via I/O interface 430, Flash memory, random access memory (RAM), etc. Program instructions and data stored on a tangible computer-accessible medium in non-transitory form may further be transmitted by transmission media or signals such as electrical, electromagnetic, or digital signals, which may be conveyed via a communication medium such as a network and/or a wireless link, such as may be implemented via network interface 440.

In some embodiments, I/O interface 430 may be configured to coordinate I/O traffic between processor 410, system memory 420, and any peripheral devices in the device, including network interface 440 or other peripheral interfaces, such as input/output devices 450. In some embodiments, I/O interface 430 may perform any suitable protocol, timing or other data transformations to convert data signals from one component (e.g., system memory 420) into a format usable by another component (e.g., processor 410). In some embodiments, I/O interface 430 may include support for devices attached through various types of peripheral buses, such as a variant of the Peripheral Component Interconnect (PCI) bus standard or the Universal Serial Bus (USB) standard, for example. In some embodiments, the function of I/O interface 430 may be split into two or more separate components, such as a north bridge and a south bridge, for example. In addition, in some embodiments, some or all of the functionality of I/O interface 430, such as an interface to system memory 420, may be incorporated into processor 410.

Network interface 440 may be configured to allow data to be exchanged between computer system 400 and other devices attached to a network, such as other computer systems, or between nodes of computer system 400. In various embodiments, network interface 440 may support communication via wired or wireless general data networks, such as any suitable type of Ethernet network, for example; via telecommunications/telephony networks such as analog voice networks or digital fiber communications networks; via storage area networks such as Fiber Channel SANs, or via any other suitable type of network and/or protocol.

As shown in FIG. 4, memory 420 may include program instructions 425, configured to implement certain embodiments described herein, and data storage 435, comprising various data accessible by program instructions 425. In an embodiment, program instructions 425 may include software elements corresponding to one or more of the various embodiments illustrated in the above figures. For example, program instructions 425 may be implemented in various embodiments using any desired programming language, scripting language, or combination of programming languages and/or scripting languages (e.g., C, C++, C#, JAVA®, JAVASCRIPT®, ANGULAR JS®, PERL®, etc.). Data storage 435 may include data that may be used in these embodiments. In other embodiments, other or different software elements and data may be included.

A person of ordinary skill in the art will appreciate that computer system 400 is merely illustrative and is not intended to limit the scope of the disclosure described herein. In particular, the computer system and devices may include any combination of hardware or software that can perform the indicated operations. Additionally, the operations performed by the illustrated components may, in some embodiments, be performed by fewer components or distributed across additional components. Similarly, in other embodiments, the operations of some of the illustrated components may not be provided and/or other additional operations may be available. Accordingly, systems and methods described herein may be implemented or executed with other computer system configurations.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A method comprising:

gathering input, by a controlled-environment facility management system, from one or more sensors, including at least one ad hoc sensor provided by at least one or more controlled-environment facility resident digital media devices, one or more controlled-environment facility resident community telephones, and/or one or more controlled-environment facility resident community videophones, disposed in portions of a controlled-environment facility, whether or not the resident digital media devices, resident community telephones and/or resident community videophones are in use;

predetermining, by the controlled-environment facility management system, a normal input level from each of the one or more sensors, the normal input level indicative of normal activity in the controlled-environment facility, proximate to a subject sensor;

determining by the controlled-environment facility management system whether the input from each of the one or more sensors rises above or falls below the predetermined normal input level for the subject sensor; and alerting controlled-environment facility personnel and/or law enforcement, by the controlled-environment facility management system, when input from one of the one or more sensors rises above or falls below the predetermined normal input level for the subject sensor.

2. The method of claim 1, wherein predetermining a normal input level for each sensor comprises determining an upper input threshold and determining a lower input threshold to define a range of the normal input level.

3. The method of claim 1, wherein alerting controlled-environment facility personnel and/or law enforcement comprises sending the controlled-environment facility personnel and/or law enforcement one or more text messages.

4. The method of claim 1, wherein alerting controlled-environment facility personnel and/or law enforcement comprises sending the controlled-environment facility personnel and/or law enforcement a feed of the sensor input.

5. The method of claim 1, wherein alerting controlled-environment facility personnel and/or law enforcement comprises sending the controlled-environment facility personnel and/or law enforcement a recording of the sensor input.

6. The method of claim 1, further comprising recording the input from one of the one or more sensors when input from one of the one or more sensors rises above or falls below the predetermined normal input level for the subject sensor.

7. The method of claim 1, wherein at least one of the one or more sensors is an audio sensor and the input is sound.

8. The method of claim 7, wherein a normal input level of sound input is based at least in part on a volume of the sound.

9. The method of claim 7, wherein a normal input level of sound input is based at least in part on recognition by the controlled-environment facility management system of particular keywords being spoken.

10. The method of claim 7, wherein a normal input level of sound input is based at least in part on a sharpness of the sound.

11. The method of claim 7, wherein the audio sensor is an ad hoc sensor and is a microphone of the controlled-environment facility resident community telephone or videophone or mouthpiece of the controlled-environment facility resident community telephone or videophone.

12. The method of claim 7, wherein the audio sensor is an ad hoc sensor and is a microphone of a controlled-environment facility resident digital media device.

13. The method of claim 1, wherein at least one of the one or more sensors is a video sensor and the input is one or more video images.

14. The method of claim 13, wherein a normal video input level is based at least in part on a speed of movement in the video images.

15. The method of claim 13, further comprising recognizing, by the controlled-environment facility management system, one or more particular persons, and wherein a normal video input level is based at least in part on separation of two or more persons including at least one or more particular recognized persons.

16. The method of claim 13, wherein a normal video input level is based at least in part on an amount of movement in the video images.

17. The method of claim 13, wherein a normal video input level is based at least in part on an amount of a particular color in the video images.

18. The method of claim 13, wherein the video sensor is an ad hoc sensor and is a camera of the resident community videophone.

19. The method of claim 13, wherein the video sensor is an ad hoc sensor and is a video camera of the controlled-environment facility resident digital media device.

20. The method of claim 1, wherein at least one of the one or more ad hoc sensors is a radio frequency identification reader and the input is telemetry of at least one radio frequency identification tag worn by a resident of the controlled-environment facility, and a normal input level is based at least in part on a speed or amount of movement in the radio frequency identification tag.

21. The method of claim 1, wherein at least one of the one or more ad hoc sensors is biometrically monitored clothing, bracelet, necklace, watch, and/or eyeglasses, and a normal input level of this one or more biometrically monitored sensors is based at least in part on normal biometric inputs from each such biometrically monitored sensor.

22. A non-transitory computer-readable storage medium having program instructions stored thereon that, upon execution by one or more computer systems, cause the one or more computer systems to:

gather audio, video and/or telemetry input from one or more ad hoc audio and/or video sensors, including at least one or more ad hoc sensors provided by at least one or more controlled-environment facility resident digital media devices, one or more controlled-environment facility resident community telephones, and/or one or more controlled-environment facility resident community videophones, disposed in portions of the controlled-environment facility and linked to the one or more computer systems, whether or not the resident digital media devices, resident community telephones and/or resident community videophones are in use;

predetermine a baseline normal input level from each of the one or more sensors, the normal input level indicative of normal activity in the controlled-environment facility, proximate to a subject sensor;

determine whether the input from each of the one or more sensors rises above or falls below the predetermined normal input level for the subject sensor; and alert controlled-environment facility personnel and/or law enforcement and stream the audio, video and/or telemetry input from the subject sensor to the controlled-environment facility personnel and/or law enforcement, in response to input from the one of the one or more sensors rising above or falling below the predetermined normal input level for the subject sensor.

23. A controlled-environment facility activity and aggression detection and monitoring system comprising:

a controlled-environment facility management system having:

at least one processor; and a memory coupled to the at least one processor, the memory configured to store program instructions executable by the at least one processor to cause the system to:

gather audio, video and/or telemetry input from one or more ad hoc sensors, including at least one or more ad hoc sensors provided by at least one or more controlled-environment facility resident digital media devices, one or more controlled-environment facility resident community telephones, and/or one or more controlled-environment facility resident community videophones, disposed in portions of the controlled-environment facility and linked to the controlled-environment facility management system, whether or not the resident digital media devices, resident community telephones and/or resident community videophones are in use;

predetermine a baseline normal input level from each of the one or more ad hoc sensors, the normal input level indicative of normal activity in the controlled-environment facility, proximate to a subject sensor;

determine whether the input from each of the one or more ad hoc sensors rises above or falls below the predetermined normal input level for the subject sensor;

record the input from the at least one of the one or more ad hoc sensors in response to input from the one or more dedicated one or more ad hoc sensors rising above or falling below the predetermined normal input level for the subject sensor; and alert controlled-environment facility personnel and/or law enforcement and provide the controlled-environment facility personnel and/or law enforcement access to a recording and/or a stream of input from the subject sensor, in response to input from the one of the one or more ad hoc sensors rising above or falling below the predetermined normal input level for the subject sensor.

* * * * *